US005358126A

United States Patent [19]

Jones et al.

[11] Patent Number: 5,358,126

[45] Date of Patent: Oct. 25, 1994

[54] HANGING-FOLDER FILE FRAME

[75] Inventors: Bruce S. Jones; William A. Putman, both of Franklin, Tenn.

[73] Assignee: Pelikan, Inc., Franklin, Tenn.

[21] Appl. No.: 148,201

[22] Filed: Nov. 3, 1993

[51] Int. Cl.[5] ..... A47F 5/00

[52] U.S. Cl. ..... 211/46; 211/189; 312/184

[58] Field of Search ..... 211/46, 162, 189; 312/184

[56] References Cited

U.S. PATENT DOCUMENTS

| | | | |
|---|---|---|---|
| 4,030,610 | 6/1977 | Alexander | 211/189 X |
| 4,049,127 | 9/1977 | Alexander | 211/189 |
| 4,176,753 | 12/1979 | Godfrey | 211/189 X |
| 4,475,657 | 10/1984 | Albery | 211/46 |
| 5,205,626 | 4/1993 | Fotioo | 211/46 X |

*Primary Examiner*—Robert W. Gibson, Jr.

*Attorney, Agent, or Firm*—John F. A. Earley; John F. A. Earley, III

[57] ABSTRACT

A hanging-folder file frame for hanging folders which have two rigid top edge members with end hooks, and a web which extends downwardly from one top edge member to a fold line and extends upwardly from the fold line to the other top edge member, comprises a first U-shaped end frame member which has a base portion with two legs that extend upwardly from the base portion and terminate in top portions, a second U-shaped end frame member which has a base portion and two legs that extend upwardly from the base portion and terminate in top portions, a pair of side rails that extend between the first and second U-shaped end frame members, and corner caps which connect the ends of the rails to the top portions of the end frame legs. The corner caps have key holes that receive keys formed in the top portions of the legs to present rotation of the corner caps. The top edge members of the hanging folders cross brace the file frame.

4 Claims, 4 Drawing Sheets

HANGING-FOLDER FILE FRAME

BACKGROUND OF THE INVENTION

1. Field of the Invention

The present invention relates to frames for supporting hanging-file folders in a drawer of a desk or a cabinet.

2. Description of the Prior Art

Hanging-file folders for drawers of desks or cabinets are in common use today. The hanging folders comprise two rigid top edge members with hooks at each end that extend downwardly and are adapted to hook over the side rails of a hanging-folder frame support. A web extends downwardly from one top edge member of the folder to a fold line, and then extends upwardly from the fold line to the other top edge member. The web holds papers in the file folder. Hanging folders have the advantage of staying upright, accessible and viewable from the top, while conventional file folders, which do not hang, may sag below the top portions of a horizontal stack of files and disappear from sight so as to be hard to find.

The hooks that extend from the rigid top edge members of hanging-file folders hold the folder in position on horizontally positioned rails of a hanging-file support frame. The hooks also slide easily along the side rails of the hanging-file support frame so that the hanging-file folders may be easily pushed back and forth to insert a file folder into the drawer or withdraw a file folder from the drawer.

An example of hanging folder frame supports is shown and described in Snowden et al. U.S. Pat. No. 4,526,277 which issued on Jul. 2, 1985.

However, conventional hanging-folder file frames are rather expensive because of their construction, and especially because of the construction of the end frames.

SUMMARY OF THE INVENTION

It is an object of this invention to provide a hanging-folder file frame which is less expensive than conventional hanging-folder file frames, and yet is just as functional and rigid. This invention contemplates supplying a file frame which has end frame members that are spartan in construction and are less expensive than conventional hanging-file end frame members. This is accomplished by utilizing the rigid top edge members of the hanging file folders to act as cross braces to hold the side rails of the file frame in position.

DETAILED DESCRIPTION OF THE DRAWINGS

Figure 1:
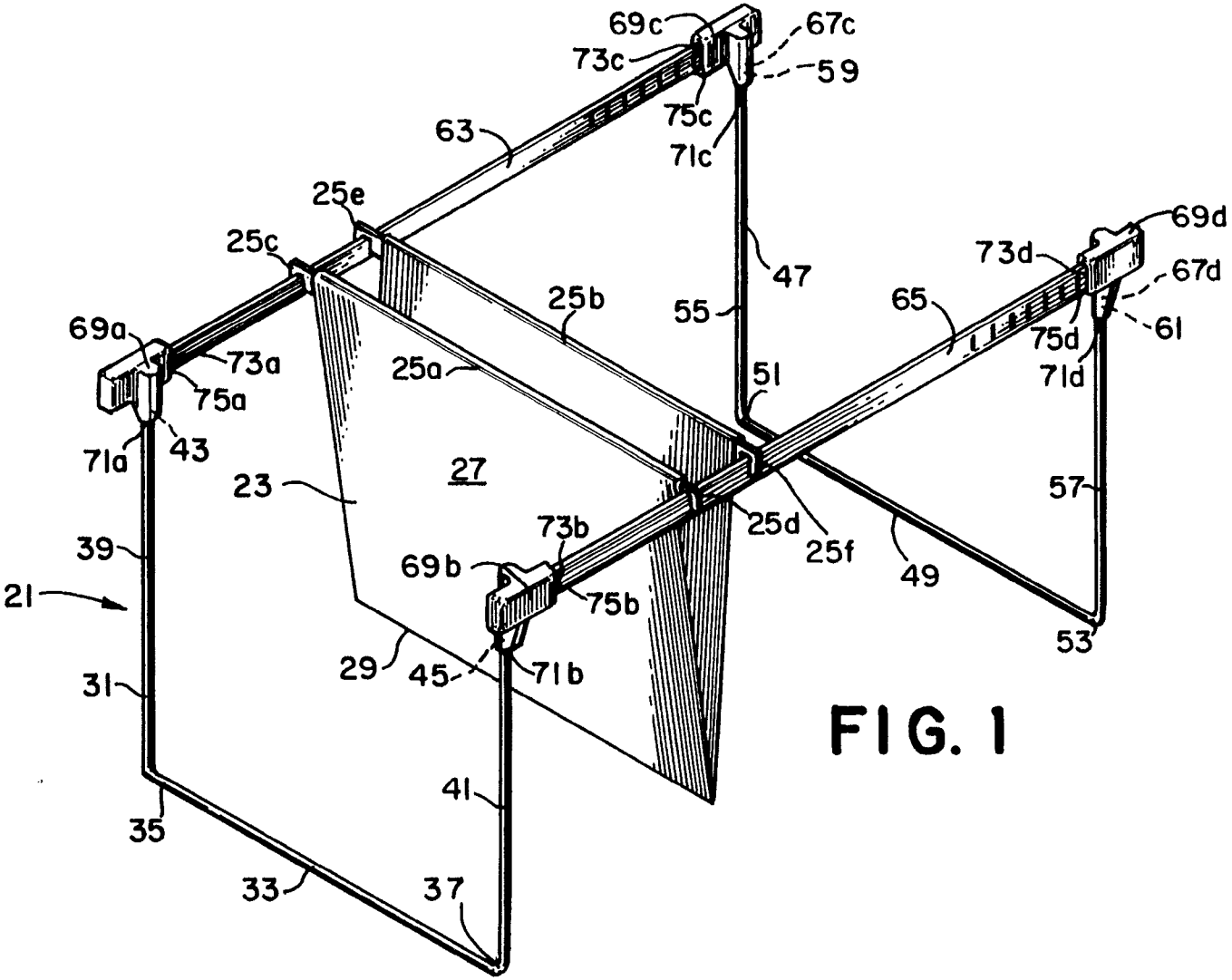
FIG. 1 is a view in perspective of a hanging-file frame constructed in accordance with this invention and shows a hanging file folder hooked over the side rails of a file frame.
Figure 4:
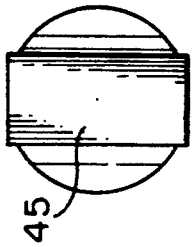
FIG. 4 is a view in top plan of the coined top portion of FIG. 3.
Figure 3:
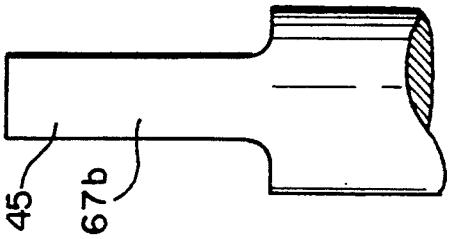
FIG. 3 is an enlarged view of the section of FIG. 2 which is indicated by the number 3 and shows the coined top portion of a leg of the end frame member.
Figure 2:
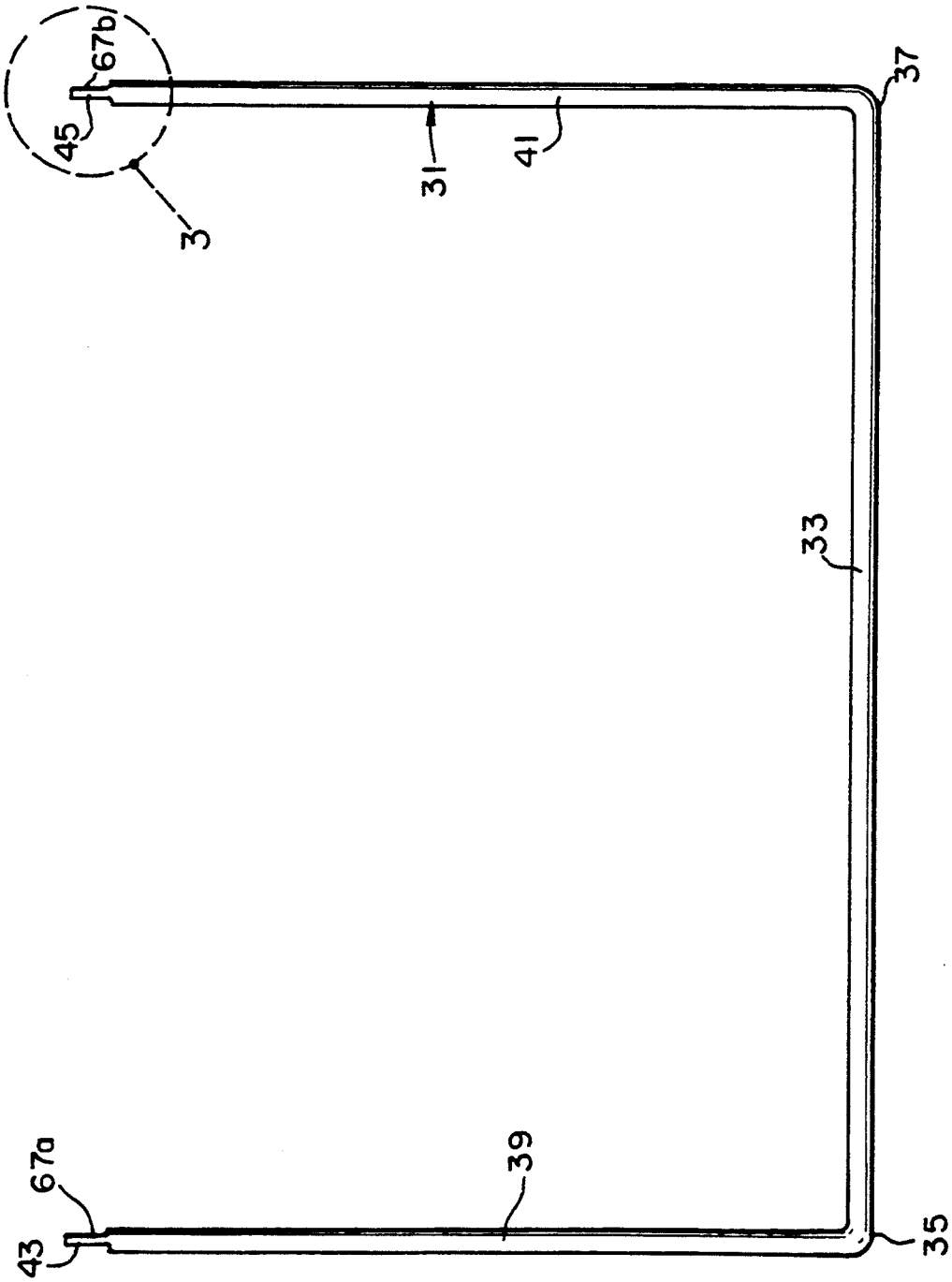
FIG. 2 shows a view in front elevation a U-shaped end frame member which forms a component of this invention.
Figure 5:
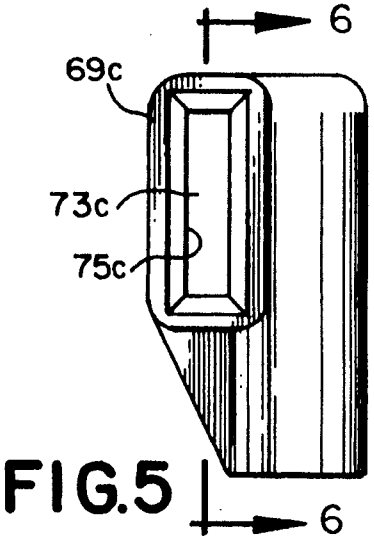
FIG. 5 is a view in front elevation of a left corner cap or tee which connects an end frame member to a side rail.
Figure 6:
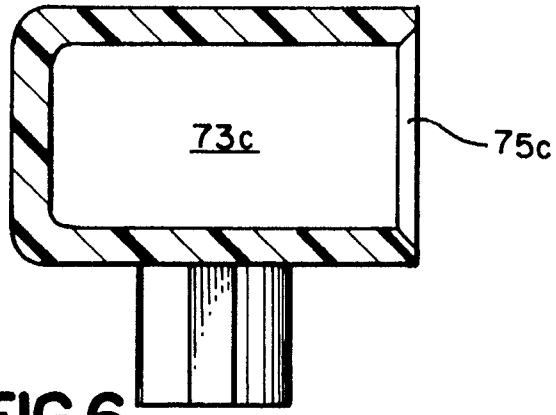
FIG. 6 is a view in section taken as indicated by the lines and arrows 6—6 which appear in FIG. 5.
Figure 9:
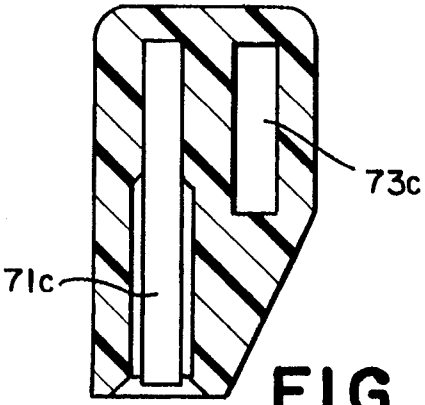
FIG. 9 is a view in cross section of the left corner cap taken as indicated by the lines and arrows 9—9 which appear in FIG. 8.
Figure 7:
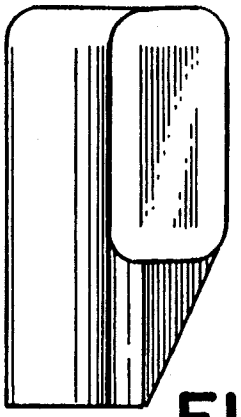
FIG. 7 is a view in rear elevation the left corner cap of FIG. 5.
Figure 8:
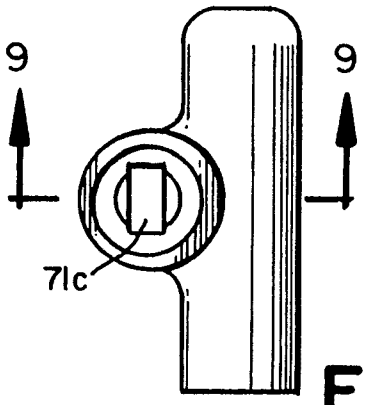
FIG. 8 is a view in bottom plan of the left corner cap of FIG. 5.
Figure 12:
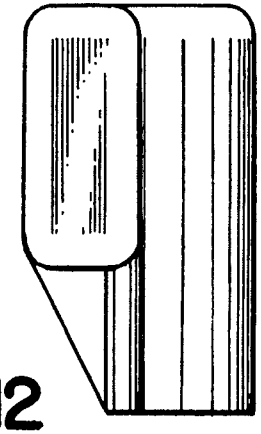
FIG. 12 is a view in rear elevation of the right corner cap of FIG. 10.
Figure 11:
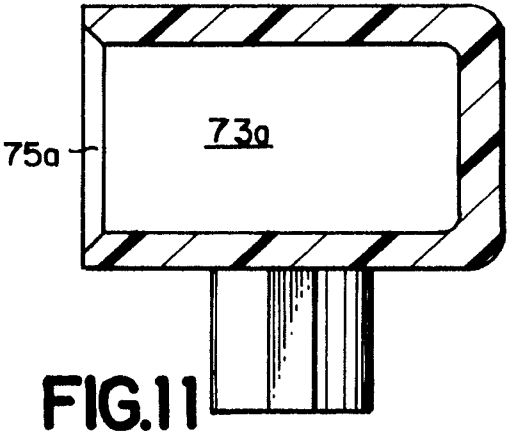
FIG. 11 is a view in section of the right corner cap taken as indicated by the lines and arrows 11—11 which appear in FIG. 10.
Figure 10:
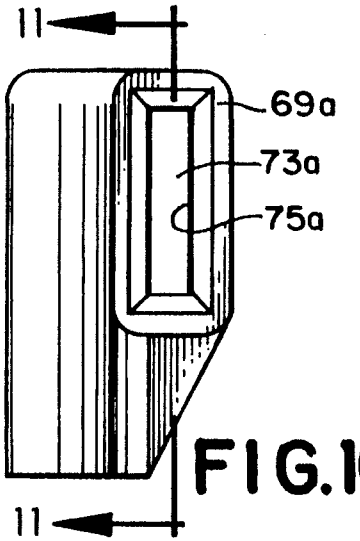
FIG. 10 is a view in front elevation of a right corner cap or tee.
Figure 13:
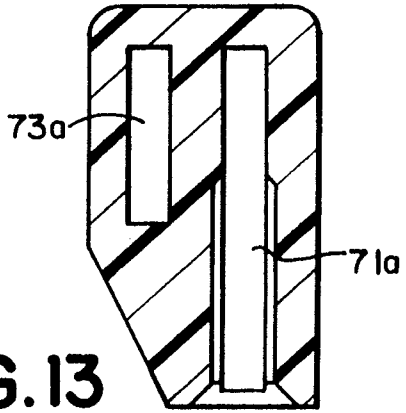
FIG. 13 is a view in bottom plan of the right corner cap of FIG. 10.
Figure 14:
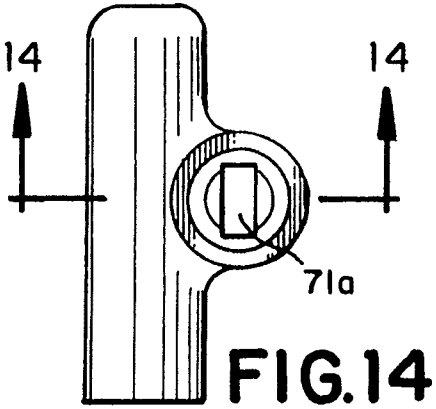
FIG. 14 is a view in section of the right corner cap taken as indicated by the lines and arrows 14—14 which appear in FIG. 13.

Turning now to the drawings, there is shown a hanging-folder file frame 21 for hanging folders 23 which have two rigid top edge members 25*a*, 25*b*, with hooks 25*c*, 25*d* and 25*e*, 25*f*. A web 27 extends downwardly from one top edge member 25*a* to a fold line 29 and extends upwardly from the fold line 29 to the other top edge member 25*b*. The web 27 holds various papers that are being kept in the file folder 23.

A first U-shaped end frame member 31 is provided having a base portion 33 with ends 35, 37 and two legs 39, 41 extending upwardly from the base portion ends 35, 37 and terminating in top portions 43, 45.

A second U-shaped end frame member 47 is provided having a base portion 49 with ends 51, 53 and two legs 55, 57 extending upwardly from the base portion ends 51, 53 and terminating in top portions 59, 61.

A pair of side rails 63, 65 extend between first frame member 31 and second frame member 47.

Corner cap means connect the ends of the side rails 63, 65 to the top portions of the legs of the end frame members.

The top portions 43, 45 and 59, 61 of the legs 39, 41 and 55, 57 are provided with coined ends 67*a*, 67*b*, 67*c*, and 67*d* that act as keys to keep corner caps 69*a*, 69*b*, 69*c*, and 69*d* from revolving around the legs 39, 41, 55, and 57. The coined ends or keys 67*a*, 67*b*, 67*c* and 67*d* are rectangular in cross section and fit into the downwardly-facing key holes 71*a*, 71*b*, 71*c*, and 71*d* in the corner caps.

A horizontally extending slot 73*a*, 73*b*, 73*c*, and 73*d* extends from the corner caps with a vertical slot opening 75*a*, 75*b*, 75*c*, and 75*d* adapted for receiving an end portion of a side rail 63, 65.

In assembly, the keys 67*a*, 67*b*, 67*c*, and 67*d* of the legs 39, 41, 55, 57 are inserted into the key holes 71, 71*b*, 71*c*, and 71*d* of the corner caps 69, 69*b*, 69*c*, 69*d*. Then the ends of the side rails 63, 65 are inserted into the slots 73*a*, 73*b*, 73*c*, and 73*d* of the corner caps. This procedure could be reversed if so desired, and the side rails could be inserted in the slots first.

The file frame 21 is placed in the cabinet drawer or desk drawer as desired, and hanging-file folders 23 are hung on the side rails 63, 65 with the hooks 25*c*–25*f* of the top edge members 25*a*, 25*b* of file folders 23 hanging outside the side rails 63, 65, and with the top edge members 25*a*, 25*b* acting as cross braces to hold the side rails 63, 65 in place.

ADVANTAGES

The hanging-folder file frame 21 of the present invention provides a file frame which is rigid in construction and which is relatively inexpensive by comparison with conventional file frames because of the inexpensive design of its end frame members and because of its utilization of the rigid top edge members of the file folders to act as a cross member brace for the file frame. Another advantage of the invention is the construction of the corner caps which rigidly connect the end frame members 31, 47 to the side rails 63, 65 and prevent rotation of the corner caps 69*a*, 69*b*, 69*c*, and 69*d* around the legs 39, 41 of frame member 31 and around the legs 55, 57 of the frame member 47.

The hanging-folder file frame 21 of the present invention provides a more competitive product while still providing quality features and meeting customer requirements.

The hanging-folder file frame 21 uses two U-shaped end frame members 31, 47, with coined top ends 67*a*, 67*b*, 67*c*, and 67*d* that act as keys to keep the plastic corner caps 69*a*, 69*b*, 69*c*, 69*d* from revolving around the legs of the frame members 31 and 49. The corner caps are molded from a synthetic resin plastic and are positioned on the coined ends or keys 69*a*, 69*b*, 69*c*, 69*d*. The flat metal side rails 63, 65 connect the two frame members 31, 47 together by inserting the ends of the side rails 63, 65 into rectangular slots 73*a*, 73*b*, 73*c*, and 73*d* that are perpendicular to the key holes 71*a*, 71*b*, 71*c*, and 71*d*. The side rails 63, 65 are held in position by the hooks of the hanging folders 23. The side rails are scored, and may be flexed and broken to adjust their length.

The file folders 23 themselves act as cross member braces for the file frame 21.

The hanging-folder file frame 21 of the present invention is economical.

Also, no screws, tapped holes, or tools are required to assemble the inventive file frame 21. Assembly is easy. The metal parts of side rails 63, 65 and coined keys 67*a*, 67*b*, 67*c*, and 67*d* of the end frame members 31 and 47 are press-fitted into the four plastic corner posts or caps 69*a*, 69*b*, 69*c*, and 69*d*.

Assembly is fast. Since no tools are needed for assembly, the file frame 21 is very quickly put together.

We claim:

1. A hanging-folder file frame for hanging folders which have two rigid top edge members with hooks at their ends, and a web extending downwardly from one top edge member to a fold line and extending upwardly from the fold line to the other top edge member, said hooks extending downwardly from each end of the top edge members and being adapted to hook over horizontal side rails of a hanging-folder file frame, comprising a first U-shaped end frame member having a base portion with ends and two legs extending upwardly from the base portion and terminating in top portions, a second U-shaped end frame member having a base portion with ends and two legs extending upwardly from the base portion and terminating in top portions, a pair of side rails extending between the first and second U-shaped end frame members, corner cap means including corner caps connecting the ends of the rails to the top portions of the legs of the end frame members, a hanging folder hanging on the side rails, and means on the folder for cross bracing the frame and holding the side rails in position said end frame member base portions being the only lower transverse members of the frame connecting the side rails together, and the rigid top edge members of the hanging folders being the only upper transverse member connecting the side rails together at the top of the frame.

2. The file frame of claim 1, including means on the legs of the end frame members and on the corner caps for preventing rotation of the corner caps around the legs of the end frame members.

3. A hanging-folder file frame for hanging folders which have two rigid top edge members with hooks at their ends, and a web extending downwardly from one top edge member to a fold line and extending upwardly from the fold line to the other top edge member, said hooks extending downwardly from each end of the top edge members and being adapted to hook over horizontal side rails of a hanging-folder file frame, comprising a first U-shaped end frame member having a base portion with ends and two legs extending upwardly from the base portion and terminating in top portions, a second U-shaped end frame member having a base portion with ends and two legs extending upwardly from the base portion and terminating in top portions, a pair of side rails extending between the first and second U-shaped end frame members, corner cap means including corner caps connecting the ends of the rails to the top portions of the legs of the end frame members, a hanging folder hanging on the side rails, and means on the folder for cross bracing the frame and holding the side rails in position said end frame member base portions being the only lower transverse members of the frame connecting the side rails together, and the rigid top edge members of the hanging folders being the only upper transverse member connecting the side rails together at the top of the frame, including means on the legs of the end frame members and on the corner caps for preventing rotation of the corner caps around the legs of the end frame members, said means for preventing rotation of the corner caps around the legs of the end frame members comprises coined ends at the top portion of each leg with the coined ends forming keys to keep the corner caps from revolving, said coined ends having a rectangular shape in cross section, a vertically disposed downwardly-facing key hole in each corner cap, said key holes having a rectangular shape in cross-section and a horizontal key hole opening for receiving said rectangularly shaped keys, side rails over which the hooks of the edge portion of hanging-file folders are placed for supporting the folders, each side rail terminating in end portions, and a horizontally extending slot formed in each corner cap with each slot having a vertical opening for receiving an end portion of a side rail.

4. A hanging-folder file frame for hanging folders which have two rigid top edge members, a file folder with a web extending downwardly from one top edge member to a fold line and extending upwardly from the fold line to the other top edge member, and hooks extending downwardly from each end of the top edge members, which hooks are adapted to hook over horizontal side rails of a hanging-folder file frame, said file frame comprising a first U-shaped end frame member having a base portion with ends and two legs extending upwardly from the base portion ends and terminating in top portions, a second U-shaped end frame member having a base portion with ends and two legs extending upwardly from the base portion ends and terminating in top portions, a corner cap mounted on the top portion of each leg, coined ends at the top portion of each leg with the coined ends forming keys to keep the corner caps from revolving, said coined ends having a rectangular shape in cross section, a vertically disposed downwardly-facing key hole in each corner cap, said key holes having a rectangular shape in cross section and a horizontal key hole opening for receiving said rectangularly shaped keys, side rails over which the hooks of a hanging-folder are placed for supporting the folders, each side rail terminating in end portions, a horizontally extending slot formed in each corner cap with each cap having a vertical slot opening for receiving an end portion of a side rail, and means for cross bracing the file frame, said cross bracing means comprising the top edge members of the hanging files.

* * * * *